United States Patent [19]

Riccitelli

[11] Patent Number: 4,697,440

[45] Date of Patent: Oct. 6, 1987

[54] METHOD AND MACHINE FOR KNITTING GARMENTS HAVING LEGS AND A BODY PORTION

[75] Inventor: Ivan Riccitelli, Lucca, Italy

[73] Assignee: Conti Paoli & Meritex S.r.l., Italy

[21] Appl. No.: 850,766

[22] Filed: Apr. 11, 1986

Related U.S. Application Data

[63] Continuation-in-part of Ser. No. 651,605, Sep. 17, 1984, Pat. No. 4,608,840.

[30] Foreign Application Priority Data

Sep. 20, 1983 [IT] Italy ..... 9518 A/83

[51] Int. Cl.[4] ..... A41B 9/00

[52] U.S. Cl. ..... 66/177; 66/179

[58] Field of Search ..... 66/174, 175, 176, 177, 66/179, 180

[56] References Cited

U.S. PATENT DOCUMENTS

| | | | |
|---|---|---|---|
| 680,355 | 8/1901 | Powell | 66/179 |
| 1,495,157 | 5/1924 | Bosworth | 66/174 |
| 2,217,022 | 10/1940 | Lawson et al. | 66/179 X |
| 2,263,829 | 11/1941 | Smith, Jr. | 66/179 |
| 3,996,768 | 12/1976 | Gariboldi et al. | 66/177 X |

FOREIGN PATENT DOCUMENTS

| | | | |
|---|---|---|---|
| 2752745 | 6/1978 | Fed. Rep. of Germany | 66/177 |

*Primary Examiner*—Wm. Carter Reynolds
*Attorney, Agent, or Firm*—McGlew and Tuttle

[57] ABSTRACT

A knitted garment, such as tights, is made using circular knitting machine for simultaneously making several pairs of the garment, with two tubular legs and a body portion having a front and a back. The machine comprises a movable unit carrying a cylinder with a circle of cylinder needles and a plate carrying an adjacent circle of plate needles. The movable unit moves with alternating rotary movement relative to several thread guides disposed around the circles of needles. In order to make several garments simultaneously, the circles are divided into as many arcuate groups of needles as there are garments. Each arcuate group is divided into two equal sub-groups separated by a middle group. The needles of each group are automatically brought into operation in a sequence to knit the toes and legs (on the subgroups), then the crotch (using the middle group as well), then the body (still using two threads, one for the left-hand and one for the linked right-hand side).

9 Claims, 7 Drawing Figures

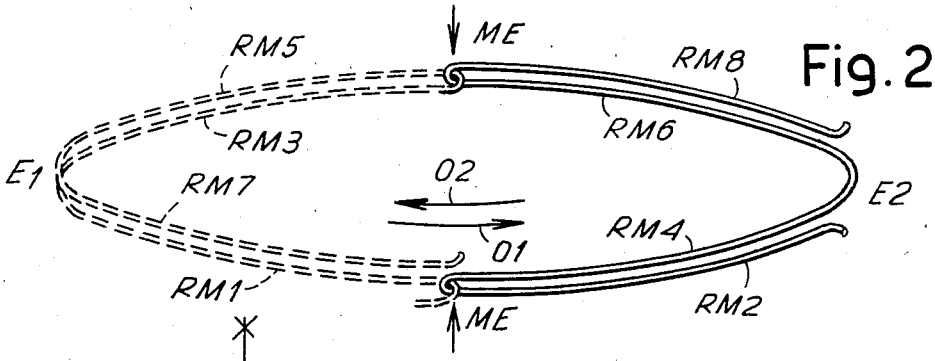
Fig. 2
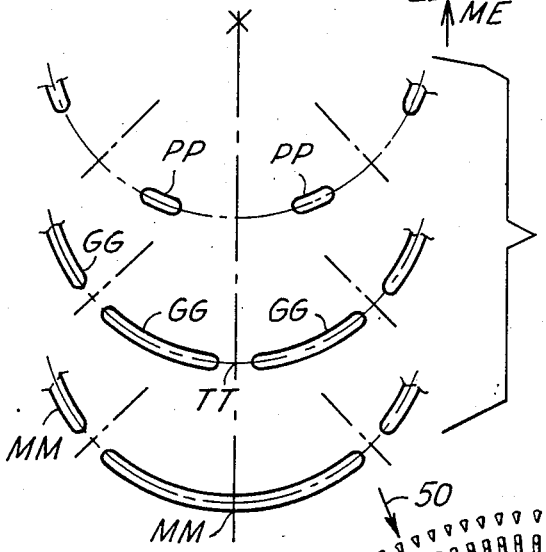
Fig. 3
Fig. 4
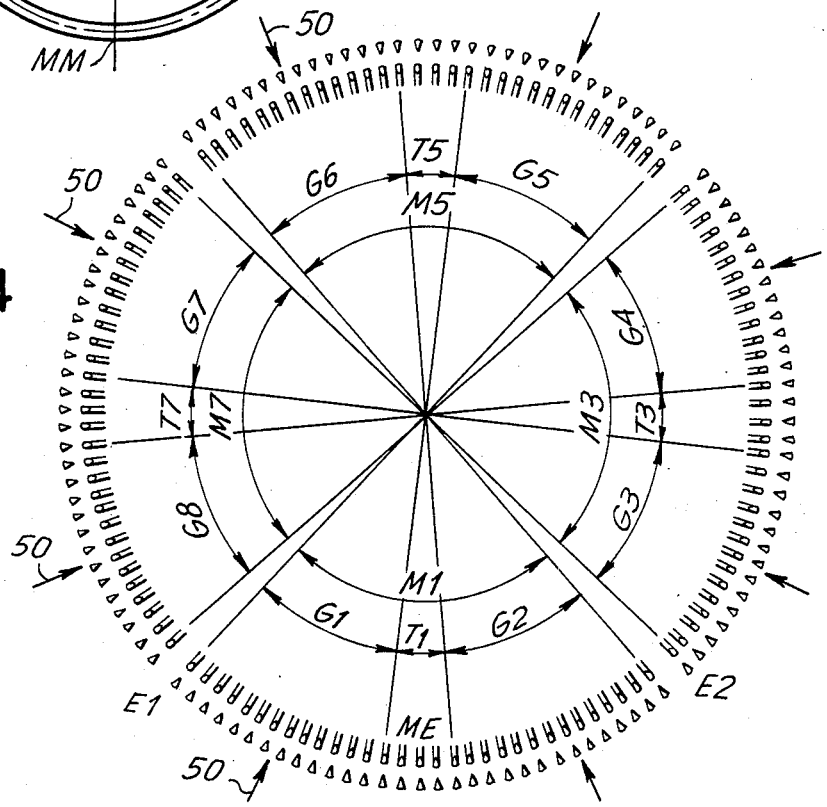

METHOD AND MACHINE FOR KNITTING GARMENTS HAVING LEGS AND A BODY PORTION

This is a continuation-in-part of co-pending U.S. application Ser. No. 651,605, filed Sept. 17, 1984, now U.S. Pat. No. 4,608,840.

FIELD OF THE INVENTION

The invention relates to a method, and to a circular knitting machine, for making tights and similar garments having a body and two tubular legs.

BACKGROUND TO THE INVENTION

A known circular knitting machine has a needle cylinder movable with alternating rotary motion, a system for controlling the needles, and a disc or plate coaxial with the cylinder and movable with it. Such a machine is not capable of producing a plurality of the garments simultaneously, each garment requiring no further process to complete it. It is an object of the invention to permit the making of a plurality of complete garments simultaneously and quickly without any operations additional to the forming of the garments on the machine.

SUMMARY OF THE INVENTION

The invention provides a circular knitting machine for making garments, such as pairs of tights, each garment constituted by a body having a front portion and a rear portion, and by two tubular legs, the machine having a needle cylinder capable of alternating rotational motion, a system for controlling the needles, and a plate coaxial with the cylinder and rotatable with it, characterized in that the needle cylinder has a number of needles, arranged in arcuate groups, at least equal to that which is necessary for making one of the two portions of the body of each of a plurality of the garments; a plate with the same number of needles running along radial channels and formed in the said arcs; said cylinder and said plate being movable with a synchronous alternating angular motion over an angle of arc at least equal to the arc occupied by the group of needles intended to form one half of said front or rear portions; and a plurality of stationary thread guides distributed around the cylinder to supply to the needles of the cylinder and of the plate two threads for each said garment, for forming the two legs and the body of the garment; in that the said control system comprises first axially stationarily positioned control means for the cylinder needles for forming the knitted garment and for the progressive insertion of different numbers of the cylinder needles in different strokes of the cylinder and plate, the first control means facing the needle arcs for each leg, and second axially stationarily positioned control means for the needles of the plate for forming the knitted garment and for the progressive insertion of corresponding different numbers of the plate needles in the said different strokes; the first control means being actuable to form the garment during each stroke in one direction with only the needles of the cylinder, and the second control means being actuable to form the garment during each stroke in the reverse direction with only the needles of the plate, progressively to form with each thread each of the legs and then to form with the two threads the corresponding areas of the front and rear portions of the body.

According to a further aspect, the invention provides a method of production of garments, such as pairs of tights, each garment having a body having a front portion and a rear portion, and two tubular legs, with a knitting machine employing alternating rotary motion of two members holding rows of needles, relative to stationary thread guides, characterized in that with respective threads from the thread guides the toes of a plurality of the garments are started simultaneously, forming rows of knitted loops which increase in length gradually with alternate strokes of the said needle-holding members to form toes and contiguous tubular legs; in that pairs of successive rows are knitted by the said members to form right-hand and left-hand portions of the front and the rear of each body portion, using for each garment two threads, with which threads also the legs are formed; and in that the said pairs of successive rows are mutually engaged along a dividing line between the right-hand and left-hand portions.

According to a further aspect, the invention provides a garment such as a pair of tights comprising: a body having a front portion and a rear portion; two tubular legs; two corresponding toes of single layer fabric with rows of knitted loops which increase gradually from the toe to the leg; at the upper end of the legs, rows longer than those which formed the two legs, to form the so-called crotch adjacent to the body; said body being made of pairs of partial rows forming the right and the left portions, respectively, of the front portion and the rear portion of the body portion, which right and left portions are divided by a corresponding dividing line therebetween, and which rows are mutually engaged in a connecting zone with at least one wale of knitted loops developed at the dividing line between the right and left portions of the body and formed with the two yarns of the contiguous rows of said two right and left portions of the body.

The invention will be better understood from the following description and with reference to the accompanying schematic drawings, by way of example only, of an embodiment of the invention.

DESCRIPTION OF THE DRAWINGS

FIGS. 2 and 3 are diagrams of the manner in which the garment is made;

FIG. 4 shows the arcuate groups of needles for the simultaneous formation of four garments;

DESCRIPTION OF THE PREFERRED EMBODIMENT

Figure 5:
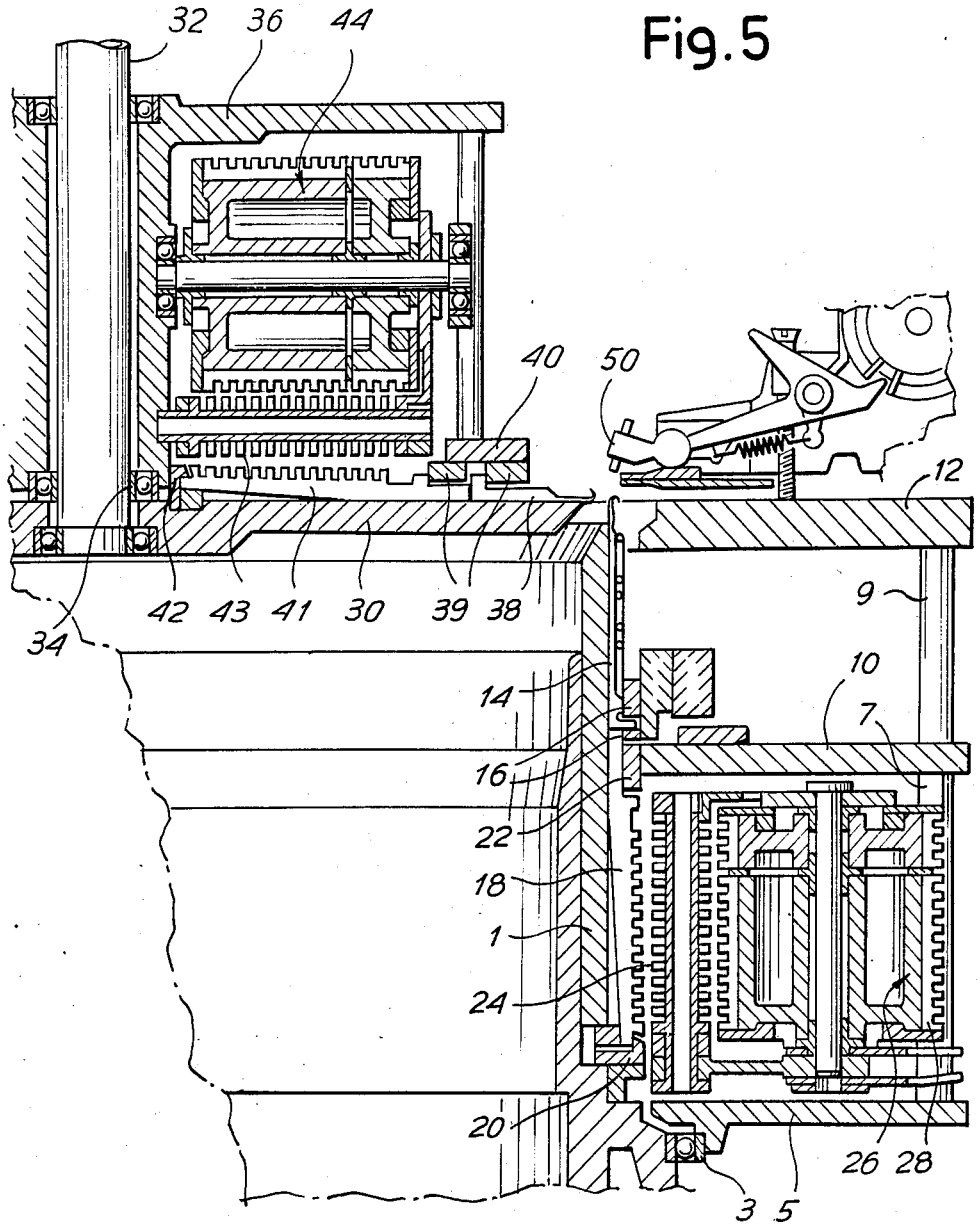
FIG. 5 show a partial vertical section of a machine according to the preferred embodiment.

The machine illustrated in FIG. 5 comprises a needle cylinder 1 mounted in traditional manner with bearings of which only the one referenced 3 is shown, to rotate with alternating motion relative to a fixed structure 5. This structure 5 by means of columns 7 and 9 supports an intermediate ring 10 and an upper ring 12, both surrounding the needle cylinder. 14 denotes the needles of the cylinder running in the longitudinal channels of the cylinder. The butts of the needles are controlled by cams and counter-cams, generally denoted by 16 and of known type, carried by the ring 10. 18 denotes oscillating selectors of known type, slidably taken up by the channels of cylinder 1 to control the raising of the needles. These selectors are able to co-operate with output cams 20 when they are not excluded from the action of one of said cams to be pushed back into the bottom of the channel; this selection arrangement is one of the traditionally known arrangements able to be used in the machine under consideration; 22 denotes the cams for lowering the selectors. For selection, selectors 18 have removable teeth upon which pushers or sliding bars 24 are able to act, controllable from time to time with substantially radial movement by a programme drum 26, of a known type, mounted for intermittent angular shifts about an axis parallel to that of cylinder 1; the programmed drum 26 has perimetrically longitudinal blades 28 with teeth distributed according to specific programmes, effected by selective removal of teeth from the individual blades. This selection arrangement and the intermittent and timely manner of advance of a drum 26 are well known in the art. Several selection arrangements are disposed around the cylinder.

Coaxially and level with the upper end of the needle cylinder a disc or plate 30 is mounted carried by a shaft 32 to rotate synchronously with the needle cylinder; the shaft 32 is mounted by means of a bearing 34, on a structure 36 which can be moved for convenience of access to the top part of the needles and also for easy access to the disc or plate 30 for maintenance or replacements. In plate 30 there are radial grooves for the movement of needles 38 which can be controlled by cams 39 mounted on an annular structure 40 supported by the structure 36. In said radial channels of the plate there are also oscillating selectors 41 similar to those denoted 18 and actuable by means of cams 42 and pushers or sliding bars 43 (similar to those marked 24) on the controlling action of a programme created in a programmed drum 44 mounted to rotate intermittently along a radial axis; said programme drum 44 is mounted on the structure 36 and controlled by intermittent advances in a manner similar to that of drum 26 and thus with systems of conventional type.

The needles 14 and the needles 38 are controlled to form—of one another—rows of loops of one and the same garment; needles 14 and needles 38 are designed to take up the thread from one and the same thread guide such as 50. Rows of loops formed by the needles 14 may be followed by rows of loops formed by the same needles or by the needles 38 and viceversa. A thread guide 50 may also be replaceable and selected from several thread guides side by side for changing at the required time the type of yarn during the making of the various areas of the same garment.

The needle cylinder 1 and the disc or plate 30 are simultaneously actuated with an alternating angular motion by means of devices typical of circular knitting machines, particularly those used for hosiery. Differently from hosiery circular machines, the machine under consideration has much greater diametral dimensions, being designed to produce several garments at the same time. In the arrangement diagrammatically represented in FIG. 4 it is provided that a machine of the type described should make four pairs of tights simultaneously, provision being made for an even angular distribution of the garments under formation along the annular zone of operation of needles 14 and 38. The individual garments are made at the peripheral annular zone of operation of the two circles of needles, the cylinder needles 14 and plate needles 38 operating to form rows at the front and rear portions respectively of the garments. In the example according to the diagram in FIG. 4, provision is made for eight arcuate groups of needles G1 . . . G8 both of the cylinder and of the plate. The needles of each arc G1 . . . G8, either of the cylinder or of the plate, are intended for the formation of a different leg of the four garments. The two needle arcs of a pair of contiguous arcs G are separated by a needle arc T1, T3, T5 and T7. The needle arcs G1, T1, G2, G3, G4; G5, T5, G6; G7, T7, G8, form needle arcs, respectively M1, M3, M5, M7, both of the cylinder and of the disc, intended to form the body part of each of the four garments. Arcs M1, M3, M5, M7 are separated by arcs either without needles or with needles which are inoperative in the arrangement illustrated in FIG. 4, intended to form four garments. To feed the needles of each of the arcs G1, G2 . . . G8, provision is made for the relevant thread guide 50. Still facing each of said arcs G1, G2 . . . G8 at least one selection unit is provided, comprising a programme drum 26 and at least one selection unit with a programme drum 44. Again facing each arc G1, G2 . . . G8 cam profiles are provided for raising and lowering both the selectors 18 and 41 and the needles 14 and 38.

Both the needle cylinder 1 and the plate 30 can move in alternating angular motion over an angle limited to the sum of an arc G and of half of arc T (plus the width of the cams operating for lifting and lowering) for the functions indicated hereinunder.

Taking into consideration that a leg must be formed with 400 needles, each of the arcs G comprises a number of needles of the order of 200 in the cylinder and as many in the plate. The arcs T will comprise, e.g. about 40 needles in the cylinder, and as many in the plate; arcs of approximately the same dimensions as arcs T are provided between the needle arcs M1, M3, M5, M7. It follows from this that both the cylinder and the plate will each have about 2000 needles. The diameter of the cylinder and that of the plate will be related to said number of needles (or to the number of needles necessary for the number of garments to be produced simultaneously) and as a function also fo the fineness of the needles selected and of the knitted fabrics of the garments to be produced.

An explanation will now be given of the modus operandi for the production of a garment, according especially to FIGS. 1 to 4.

The garment is started from the toes PP, continued to form the legs GG, then the so-called crotch area TT and finally the area of the body MM with the relevant final elastic edge EE.

Having imparted an alternating motion to the cylinder and at the same time to the plate, operations are begun to lift a limited number of needles 14 at the centre of each of the arcs G1 . . . G8 of the cylinder during the movement in one direction of the apparatus 1-30 of cylinder and plate; during the reverse movement the corresponding needles 38 of the plate are caused to project radially in a centrifugal direction, and therefore they "lift". The formation of the toes is continued during alternating strokes of said apparatus, before which strokes the progressive insertion is effected of further needles at the ends of the needle arcs already operating, both of the cylinder and of the plate, in substantially symmetrical manner. There are then formed for each of the eight legs rows RC1 between the points A1, B1 with the cylinder needles and rows RC2 between the points B1, A1 with the needles of the plate, the rows being gradually increased as they are developed with successively greater arcs such as the one defined by points A1, B2, until the insertion of all the needles of the arcs G is reached to form rows RC3 between the points A3, B3 and RC4 between the points B3, A3 respectively, with the needles of the cylinder during movement in one direction and with the needles of the plate during movement in the reverse direction. Each leg is then formed starting from the toes PP, the front face formed by the rows produced by the needles 14 of the cylinder and the rear face formed by the rows produced by the needles 38 of the plate; the thread passes alternately from the partial front rows to the rear ones, being presented and fed at the same point by the respective thread guide, as the thread is seized from time to time by the raised needles.

The knitted fabric of the two contiguous legs GG, formed for example by the needle arcs G1 and G2 (the same applies to the arcs G3, G4; G5, G6; G7, G8), after said legs have been completed to the desired length, must be continued to form the body MM. After having formed the end rows RC5 and RC6 between the points A5, B5 and A7, B7, thus completing the length of the legs, the needle selection programme imposes the simultaneous or progressive insertion, of the needles of arc T1 comprised between the arcs G1 and G2 both in the cylinder and in the plate; the progressive character of the insertion will take place between the ends of the arc T1 and the centre of said arc T1; RC7 and RC8 denote rows of loops of progressively increasing length formed in the crotch area TT, between points A9, B9 and A10, B10. Having reached the end of the crotch, i.e. point TE in FIG. 1, when all the needles of the arc T1 have been inserted, the formation of the body is begun with a number of needles equal to the sum of the needles of arcs G1, T1, G2 both of cylinder and plate.

For the formation of the body use is made of the two threads fed by two thread guides 50 belonging to the arcs G1 and G2. At each oscillation in the two directions of the cylinder and plate unit two rows of loops are formed, for the right-hand and the left-hand areas respectively of the body MM. With particular reference to FIGS. 2 and 4, starting for example from the extreme outer point E2 of the needle arc G2 there is formed with a thread and in terms of arcs of fabric being considered as being knit in the direction opposite to the direction of needle cylinder and plate motion during the swinging in one direction 01-a row of loops RM2 with the needles of the cylinder of the arc G2 between the point E2 and the centre point ME of arc G2, T1, G1; simultaneously there is formed with the other thread a row of loops RM1 with the thread belonging to the needle arc G1 between the point ME and the point E1, still with the needles of the cylinder. The swinging stroke in the direction of the arrow 01 having ended, reversing the movement of the cylinder and of the plate along the arrow 02, a second row RM4 is formed with the needles of the cylinder comprised between the point ME and the point E2, and simultaneously a row of loops RM3 is formed with the needles of the plate between the point E1 and the centre point ME. During a new swing in the direction of arrow 01 a row RM6 is formed with the needles of the plate and with the thread of the arc G2 between point E2 and point ME and simultaneously a row of loops RM5 is formed with the needles of the plate and with the thread of the arc G1 between point ME and point E1. A fourth swing along 02 determines the formation of a row of loops RM8 between the centre point ME and the end E2 with the needles of the plate and a row of loops RM7 between the end E1 and the point ME with the needles of the cylinder.

The alternating motion continues until all the body MM and the elastic edge EE have been formed.

Figure 1:
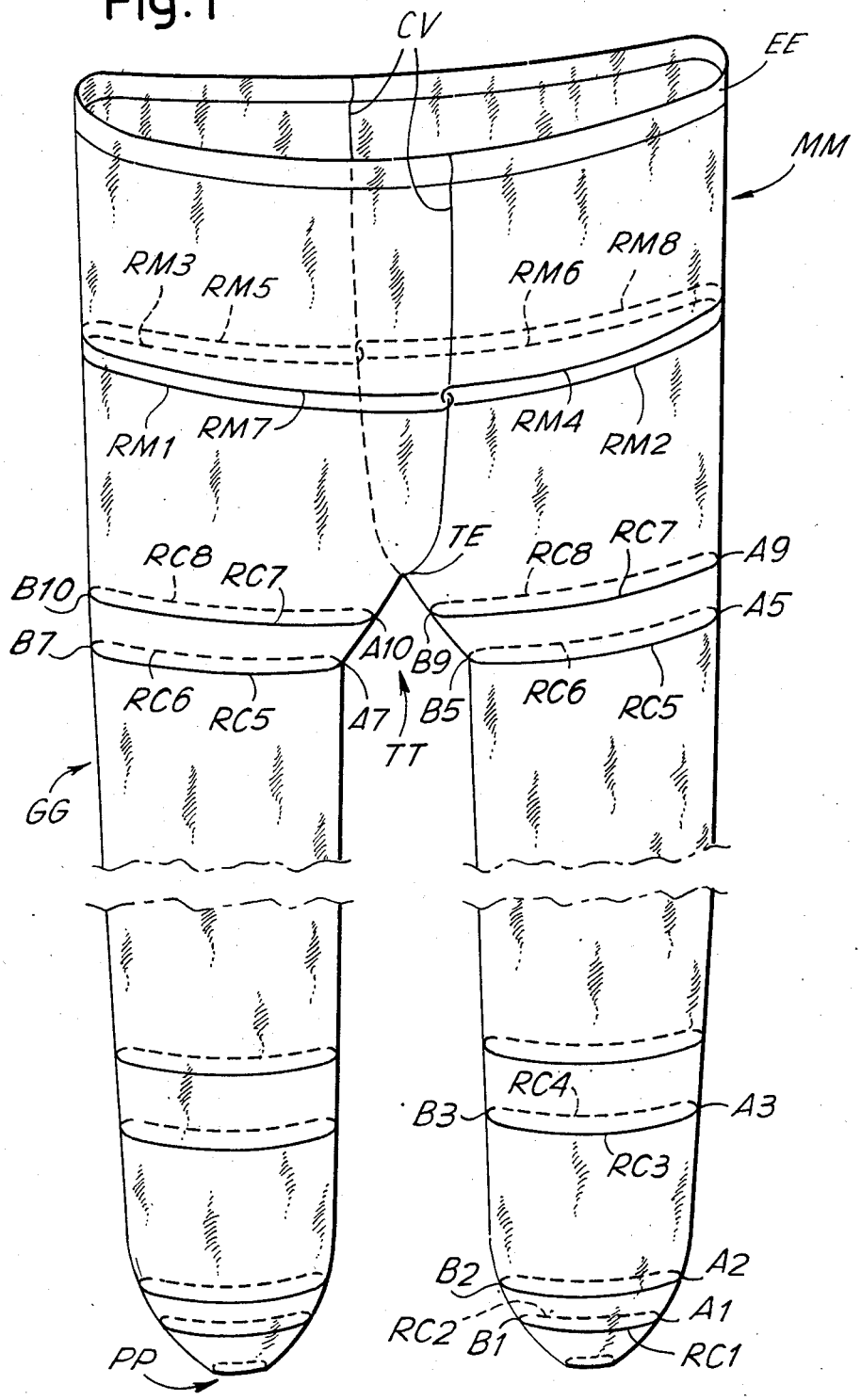
FIG. 1 is a diagram of a garment which can be made according to the invention.

It will be noted that to hook together at points ME the rows of loops RM2, RM4 on the one hand, RM1, RM7 on the other, and RM6, RM8 on the one hand, and RM3, RM5 on the other, respectively, formed by the needles of the cylinder and by the needles of the plate, along the so-called dividing line denoted by CV in FIG. 1 and therefore in the central area of the needle arcs T1, T3, T5 and T7, both of the cylinder and of the plate, at least one needle or a limited group of needles (of the cylinder and of the plate) are controlled to engage the two threads which are fed facing the needle arcs such as G1 and G2. This or these needles can form loops on every occasion, or also engage the thread and hold the loop to form loops only once with both threads.

Figure 6:
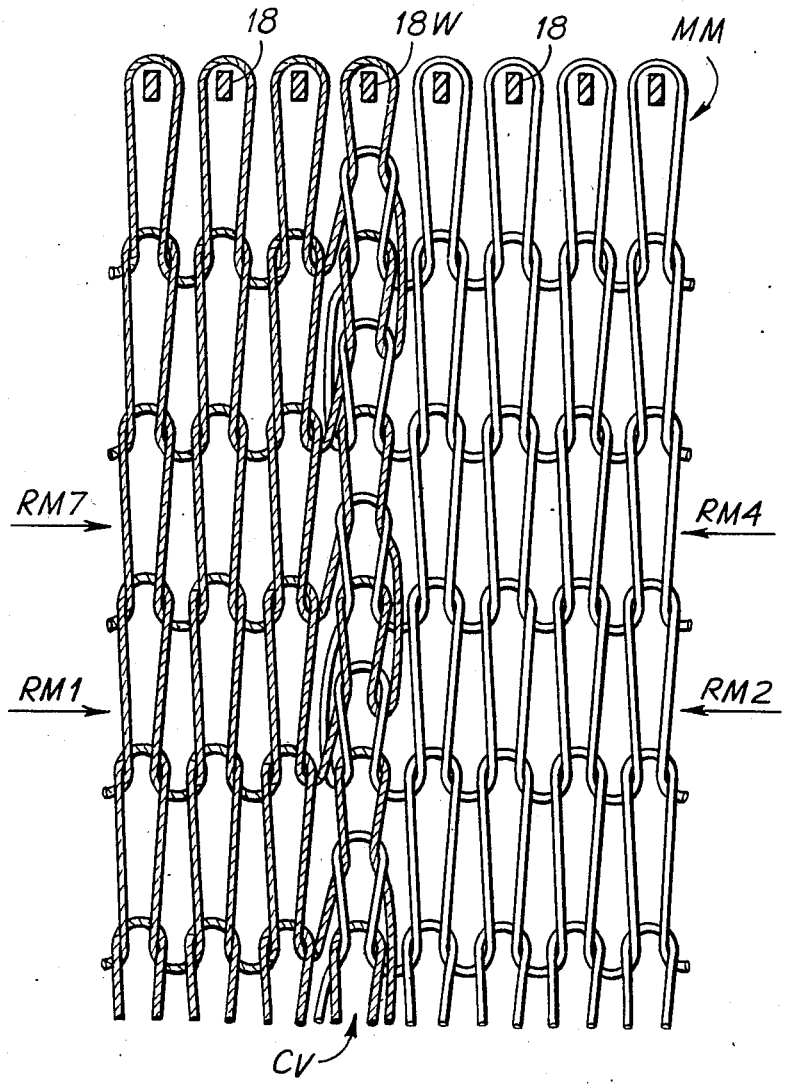
FIGS. 6 and 7 shows two fabric structures in a dividing line.

FIG. 6 shows a detail of a fabric structure in the said zone CV, where the horizontal rows RM1, RM2, RM7, RM4 are indicated; one of the two yarns or threads is dotted in order to distinguish it from the other. Along the so-called longitudinal or vertically extending dividing line CV, at least one needle 18W is operated to make loops both with the yarn forming the transverse semi-rows RM2 and RM4 (and equivalents, e.g. the rear transverse semi-rows RM5 and RM3) and with the yarn forming the semi-rows RM1 and RM7 (equivalents, e.g. rear transverse semi-rows RM6 and RM8). Thereby, along the line CV, there is obtained a connection structure between the right and left portion of fabric, which is constituted by at least one longitudinal or vertically extending wale of loops (formed by the needle or needles 18W) with twice the number of loops formed by each of the adjacent needles 18.

Figure 7:
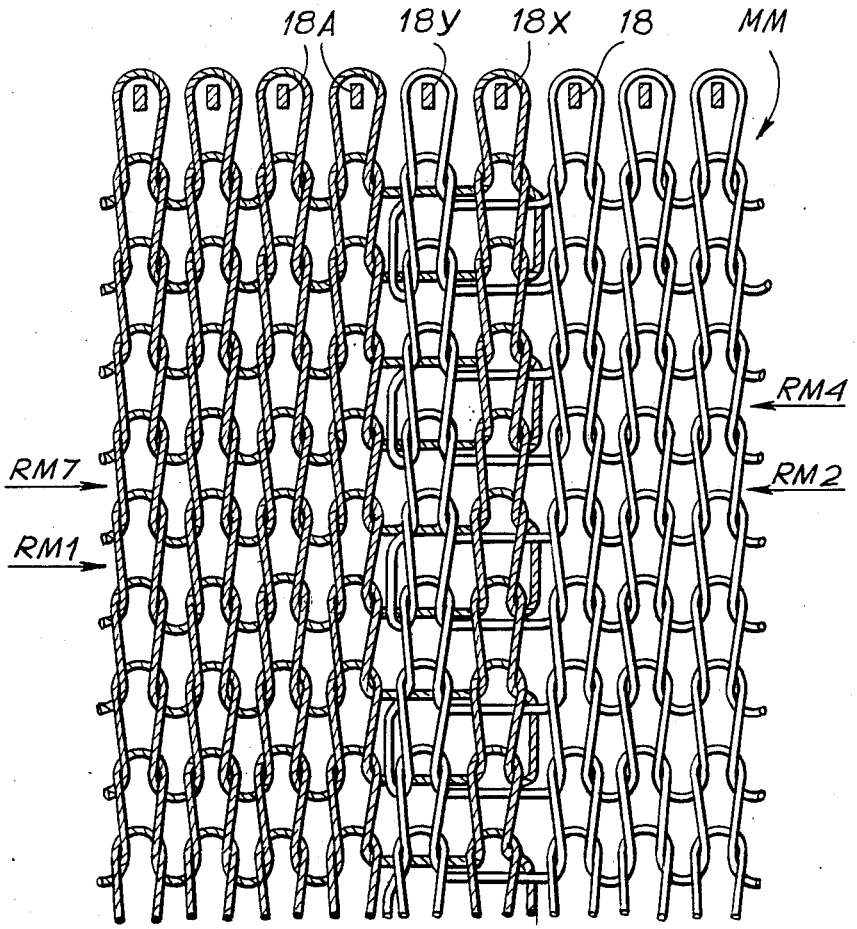

FIG. 7 shows a detail of a fabric structure in the above said zone CV, according to a solution which differs from the one of FIG. 6. Also in FIG. 7 the rows RM2 and RM4 are indicated, as well as those RM1 and RM7. In the zone CV, at least one particular needle 18X and at least one particular needle 18Y serve the purpose of realizing the connection between the two zones, the left zone ZA and the right zone ZB, which are formed respectively by the needles 18A and by the needles 18B. Together with the needles 18A needle or needles 18X are operated in order to form the rows like those RM1 and RM7; together with needles 18B needle or needles 18Y are operated in order to form the rows like those RM2 and RM4. In the zone CV, i.e., in coincidence with the needles 18X and 18Y, the yarns of the two parts A and B are overlapping, but no double number of loops is made.

Thus, per FIG. 7, the connection zone of the body portion of the fabric structure is such that the knitting loops ME along two non-contiguous side by side rows of loops, developed at the dividing line CV between the right and left portions or zones, are formed with the two yarns or threads of the contiguous rows of the right and left portions of the body portion.

According to another possible structure of the zone CV, at least one needle can form and retain the loop formed with one yarn, form the loop with the other yarn and then form a single loop with the two yarns.

The selections of the needles to obtain the insertion during the formation of the toes PP, the insertions during the formation of the area TT of the crotch and to determine the lifting and lowering at the proper time of the needles of one and the other front members to form the respective rows, are conveniently obtained through the two selection programmes supplied by drums 26 and 44 respectively. It is obvious that when the cylinder needles are operating along an arc, those of the plate cannot operate, and vice-versa. The spaces without needles between the arcs M1, M3, M5, M7 during the formation of the body, and the arcs with needles which are inoperative such as T1, T3, T5, T7 during the formation of the legs, ensure that the fabric of the various rows can be properly made, even though the amplitude of the alternating angular travel of the cylinder and plate assembly is greater than the amplitude of the row of loops to be made. Even when rows of contiguous loops are formed simultaneously with the needles of the same rotary member (i.e. the cylinder or plate) and with two contiguous thread guides, as in forming the body, the formation of the loops of the two rows always takes place instantaneously in different areas of the periphery of the machine.

It is possible to provide for the simultaneous formation of more or fewer than four garments on the same machine, and it is also possible to provide for the simultaneous insertion of two needles or of all the needles in arcs T1, T3, T5, T7. It is further possible to provide for the formation of the toes with extensions suitably established adjacent the toes PP, after first lifting all the needles of the arcs G.

The machine can also make garments other than tights.

I claim:

1. Knitted garment comprises a longitudinal tubular body formed of horizontal rows of knitted loops, including a left side portion formed of horizontal rows of knitted loops of a left thread and having a left front longitudinal edge defined by a left front longitudinal edge wale of knitted loops of left thread and a left rear longitudinal edge defined by a left rear longitudinal edge wale of knitted loops of left thread, and a right side portion formed of horizontal rows of knitted loops of a right thread and having a right front longitudinal edge defined by a right front longitudinal edge wale of knitted loops of right thread and a right rear longitudinal edge defined by a right rear longitudinal edge wale of knitted loops of right thread, the number of knitted loops in each of the horizontal rows of knitted loops formed by the left and right threads in the left and right side portions of the body being constant;

a front longitudinal connecting zone of knitted loops including at least one front longitudinal connecting wale of knitted loops, the front zone being located between the left and right front edge wales of loops and being formed with the two threads which form the left and right front edge wale of loops, and the front zone mutually engaging the left and right front edge wales of loops such that loops of the front zone correspondingly engage loops of the left and right front edge wales for connecting together the left front edge of the left side portion and the right front edge of the right side portion;

a rear longitudinal connecting zone of knitted loops including at least one rear longitudinal connecting wale of knitted loops, the rear zone being located between the left and right rear edge wales of loops and being formed with the two threads which form the left and right rear edge wales of loops, and the rear zone mutually engaging the left and right rear edge wales of loops such that loops of the rear zone correspondingly engage loops of the left and right rear edge wales for connecting together the left rear edge of the left side portion and the right rear edge of the right side portion;

a crotch portion contiguous with the body and defining left and right tubular leg opening portions correspondingly formed of such rows of knitted loops, such that the left leg opening portion is formed of the left thread and the right leg opening portion is formed of the right thread;

left and right tubular leg portions respectively contiguous with the left and right tubular leg opening portions of the crotch portion and respectively formed of such rows of knitted loops, such that the left tubular leg portion is formed of the left thread and the right tubular leg portion is formed of the right thread, the knitted loops of the left and right tubular leg openings extending in a direction toward the body;

left and right toe portions of single layer knitted fabric, respectively contiguous with the left and right tubular leg portions and respectively formed of such rows of knitted loops, such that the left toe portion is formed of the left thread and the right toe portion is formed of the right thread.

2. Garment of claim 1 wherein at least one of the front zone and the rear zone includes at least one double number loop longitudinal connecting wale of knitted loops formed with twice the number of loops as those in the corresponding left and right edge wales of loops thereat, the loops of the double number loop connecting wale being formed alternately of the left thread and right thread to provide an alternating left and right thread set of loops in such connecting row.

3. Garment of claim 1, wherein at least one of the front zone and the rear zone includes a left longitudinal connecting wale of knitted loops formed of the right thread and a right longitudinal connecting wale of knitted loops formed of the left thread, such that the left connecting wale formed of the right thread is located between the left edge wale formed of the left thread and the right connecting wale formed of the left thread, and such that the right connecting wale formed of the left thread is located between the left connecting wale formed of the right thread and the right edge wale formed of the right thread.

4. Garment of claim 1, wherein at least one of the front zone and the rear zone includes at least one double thread longitudinal connecting wale of knitted loops, such that each loop is a double thread loop formed with the corresponding left and right threads together.

5. Knitted garment comprising a longitudinal tubular body formed of horizontal rows of knitted loops, including a left side portion formed of horizontal rows of knitted loops of a left thread and having a left front longitudinal edge wale of knitted loops of left thread and a left rear longitudinal edge defined by a left rear longitudinal edge wale of knitted loops of left thread, and a right side portion formed of horizontal rows of knitted loops of a right thread and having a right front longitudinal edge defined by a right front longitudinal edge wale of knitted loops of right thread and a right rear longitudinal edge defined by a right rear longitudinal edge wale of knitted loops of right thread, the number of knitted loops in each of the horizontal row of knitted loops formed by the left and right threads in the left and right side portions of the body being constant, a front longitudinal connecting zone of knitted loops including at least one front longitudinal connecting wale of knitted loops, the front zone being located between the left and right front edge wales of loops, and the front zone mutually engaging the left and right front edge wales of loops such that loops of the front zone correspondingly engage loops of the left and right front edge wales for connecting together the left front edge of the left side portion and the right front edge of the right side portion;

a rear longitudinal connecting zone of knitted loops including at least one rear longitudinal connecting wale of knitted loops, the rear zone being located between the left and right rear edge rows of loops and being formed with the two threads which form the left and right rear edge wales of loops, and the rear zone mutually engaging the left and right rear edge wales of loops such that loops of the rear zone correspondingly engage loops of the left and right rear edge wales for connecting together the left rear edge of the left side portion and the right rear edge of the right side portion, and a crotch portion contiguous with the body and defining left and right tubular leg opening portions, left and right tubular leg portions correspondingly contiguous with the left and right tubular leg opening portions of the crotch portion, and left and right toe portions of single layer knitted fabric and correspondingly contiguous with the left and right leg portions, the leg opening portions of the crotch portion, leg portions and toe portions being correspondingly formed of such rows of knitted loops, such that the left leg opening portion of the crotch portion, left leg portion and left toe portion are formed of left thread, and such that the right leg opening portion of the crotch portion, right leg portion and right toe portion are formed of right thread, the knitted loops of the left and right leg portions extending away from the left and right toe portions.

6. A garment such as a pair of tights comprising: a body having a front portion and a rear portion; two tubular legs; two corresponding toes of single layer fabric with rows of knitted loops which increase gradually from the toe to the leg, the knitted loops of each leg extending away from the toe; at the upper end of the legs, rows longer than those which formed the two legs, to form a crotch adjacent to the body; said body being made of pairs of partial rows forming the right and the left portions, respectively, of the front portion and the rear portion of the body portion, which right and left portions are divided by a corresponding dividing line therebetween, and which rows are mutually engaged in a connecting zone with at least one wale of knitted loops developed at the dividing line between the right and left portions of the body and formed with the two yarns of the contiguous rows of said two right and left portions of the body, the number of loops in each of the rows of the right and left portions being constant along the body.

7. A garment according to claim 6, wherein, the connecting zone includes longitudinal wales of loops of the right and left portions of the body portion, and there is at least one longitudinal wale of loops formed by twice the number of loops, said last loops being formed alternately by the yarn of the right part and by the yarn of the left part of the body portion.

8. A garment according to claim 6, wherein the loops of the said at least one wale of loops are spaced apart from the loops of the right portion of the body portion and are formed with the same yarn forming the loops of said right portion, and wherein, with the yarn forming the loops of the left portion of the body portion, there are also formed the loops of at least one longitudinal wale of loops comprised between those made by the yarn forming the right portion of the body portion.

9. A garment according to claim 6, wherein, between the rows of loops of the right and left portions of the body portion, in the connection zone, the loops of the one wale of loops are formed by the two yarns of the right portion and of the left portion of the body portion.

* * * * *

UNITED STATES PATENT OFFICE

CERTIFICATE OF CORRECTION

Patent No. 4,697,440 Dated October 6,1987

Inventor(s) Ivan Riccitelli

It is certified that error appears in the above-identified patent and that said Letters Patent are hereby corrected as shown below:

On the title page

The Assignee's name should read Conti Paolo ,not Paoli

Signed and Sealed this

Twenty-first Day of June, 1988

*Attest:*

DONALD J. QUIGG

*Attesting Officer*

*Commissioner of Patents and Trademarks*